US005532052A

United States Patent [19]

Eng et al.

[11] Patent Number: 5,532,052

[45] Date of Patent: Jul. 2, 1996

[54] WARP-KNITTED CAMOUFLAGE MATERIAL

[75] Inventors: Kjell Eng, Mullsjö; Erik Wallin, Gamleby, both of Sweden

[73] Assignee: Barracuda Technologies AB, Gamleby, Sweden

[21] Appl. No.: 343,564

[22] PCT Filed: Apr. 13, 1994

[86] PCT No.: PCT/SE94/00325

§ 371 Date: Jan. 4, 1995

§ 102(e) Date: Jan. 4, 1995

[87] PCT Pub. No.: WO94/24510

PCT Pub. Date: Oct. 27, 1994

[30] Foreign Application Priority Data

Apr. 15, 1993 [SE] Sweden ..... 9301235-9

[51] Int. Cl.[6] ..... D03D 3/00

[52] U.S. Cl. ..... 428/229; 428/225; 428/247; 428/253; 428/254; 428/263; 428/285; 428/299; 428/301; 428/919

[58] Field of Search ..... 428/253, 229, 428/919, 247, 263, 299, 301, 125, 254, 285

[56] References Cited

U.S. PATENT DOCUMENTS

| | | | |
|---|---|---|---|
| 3,069,796 | 12/1962 | Rüter | 41/10 |
| 3,733,606 | 5/1973 | Johansson | 343/18 A |
| 4,064,305 | 12/1977 | Walin | 428/246 |
| 4,671,988 | 6/1987 | Dowell | 428/226 |

FOREIGN PATENT DOCUMENTS

| | | |
|---|---|---|
| 2289146 | 11/1990 | Japan . |
| 2078799 | 1/1982 | United Kingdom . |

*Primary Examiner*—James J. Bell

*Attorney, Agent, or Firm*—Lee, Mann, Smith, McWilliams, Sweeney & Ohlson

[57] ABSTRACT

A camouflage material having radar screening properties is comprised of a warp-knitted fabric, so-called Raschel fabric, which includes yarn into which metal fibres have been spun. The yarn is laid with a lay-out technique such that the sum of the extensions of the yarn will be generally the same in each direction in the plane of the fabric. The fabric is suitably stabilized with a sheet that lacks metal fibres, which may either be a yarn layer in the warp-knitted fabric or a through-knitted fabric, preferably a nonwoven fabric coated with a reflective metal layer.

8 Claims, 3 Drawing Sheets

WARP-KNITTED CAMOUFLAGE MATERIAL

The present invention relates to camouflage material having a radar screening effect and comprising warp-knitted fabric in which at least part of the yarn in the fabric contains metal fibres.

U.S. Pat. No. 3,733,606 discloses camouflage means which function against radar reconnaissance, and also discloses a suitable surface resistivity in this regard. It is also known in this context to sometimes include metal wires or filaments textile yarns, such as cut pieces of thin metal wire or filament which are spun together with other fibres, either natural or synthetic fibres, to form a yarn which is later used as the warp and weft yarn in weaving processes. A good camouflaging effect is achieved when the surface resistance is suitably balanced, a practical standard in this regard being 300 Ohms per square. In certain cases, however, a lighter and more airy fabric is desired, which cannot be achieved by weaving, therewith leaving the alternative choice of knitted fabrics. The alternative possibility of weaving a wider mesh is not a suitable alternative, since the yarns will slip and slide unless glued together. Furthermore, a woven fabric cannot be draped as well as or will not fall as well as a knitted fabric.

U.S. Pat. No. 4,064,305 discloses knitted camouflage material. This material, however, has been devised with the intention of improving the wear properties and the stability properties of the material in relation to woven fabrics with regard to the radar defeating properties of the material when the material is in folds or is creased. According to this patent specification, the usable radar properties are achieved by a stretching process followed by fixation to a supportive sheet.

An object of the present invention is to provide a light-weight knitted fabric which can be used for camouflaging purposes, either as it is or when leaf-cut in the manner disclosed in the first-mentioned U.S. patent specification. Another object of the invention is to provide a warp-knitted fabric which exhibits from the beginning uniform radar reflexion and transmission respectively, as far as the polarization direction is concerned.

According to one particular aspect of the invention, an object is to provide a ready knitted fabric which exhibits good radar properties and which is effective in the infrared range, by "knitting together" or union knitting with a sheet or layer that reflects in the infrared range.

These objects of the invention and advantages afforded thereby are achieved in that in a camouflage material of the kind defined in the introduction the metal yarn containing the metal fibres is inlaid with a lay-out technique such that the sum of the extensions of the yarn will be essentially the same in each direction in the plane of the textile.

Expressed schematically, this means that it shall be endeavoured to produce relatively long float stitches with the yarn containing the metal fibres. It should also be endeavoured to obtain a knitted structure which gives low elasticity.

Yarn in which conductive material has been spun is relatively expensive to produce, and it is therefore suitable to lay this yarn in a fabric of some other kind, using conventional yarn as a carrier, or optionally, according to one variant, to knit-in a layer, which may be a gauze layer (nonwoven) provided with a metal layer, for instance a vapour deposited aluminium layer. This will also result in a less elastic fabric.

In order to obtain a visual camouflaging effect, it is suitable to colour the knitted material in patches. This can be achieved advantageously by pattern spraying with a dispersion water-based paint, which when drying and heated to a temperature of, e.g., 180° C. for 30–40 seconds, will form a chemical bond with the fibre.

If the material is to be included in a net, it is suitable to leaf-cut in the manner described in U.S. Pat. No. 3,069,796, and fasten the material to a supportive net structure in a known manner. A quilting technique is preferred in this regard.

The invention will now be described with reference to exemplifying embodiments thereof and also with reference to the accompanying drawings.

BRIEF DESCRIPTION OF THE DRAWINGS

FIG. 1A is a schematic view of an inventive fabric, whereas

EXAMPLE 1

Figure 1A:
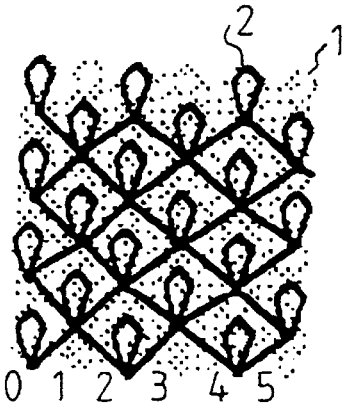
Figure 1B:
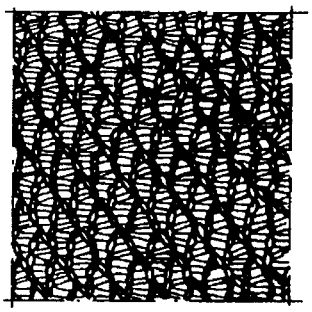
FIG. 1B is an enlarged photocopy of the actual fabric taken on a conventional office copying machine.

The fabric illustrated in FIGS. 1A and 1B is a warp-knitted fabric which can be produced on a Raschel knitting machine having two or three bars. The machine used in the present case had twenty-two needles per inch. Three yarn systems were included:

I. One yarn system of non-reflecting yarn in 50 detex polyester with a yarn lay-out pattern of: 10/34 and all yarn guides threaded (the rear bar);

II. One yarn system with radar reflecting yarn in Nm 68/1 (polyester with a 5% steel admixture), with a yarn lay-out pattern of 10/12/23/12/ and each alternate yarn guide threaded (centre bar); and III. One yarn system with the same yarn as in II., but with each alternate (intermediate) yarn guide threaded and with a yarn lay-out pattern of 23/21/10/12.

The steel fibre admixture comprised 8 μm drawn steel fibre chopped into lengths of 5–6 cm.

The yarn, or thread, system I. is shown as a dotted structure schematically in FIG. 1A, whereas the yarn or thread systems II. and III. are shown in heavy lines 2. FIG. 1B shows essentially only the yarn systems II. and III.

The yarn lay-out notations given above are conventional notations, meaning that any person skilled in the art of warp weaving will be able to produce the fabric on the basis of the aforegoing. The yarn system I. with its long float stitches and stabilized by the two remaining systems affords good stiffness in the width direction, while the two remaining systems give rise to good stiffness in the longitudinal direction/warp direction.

Figure 4A:
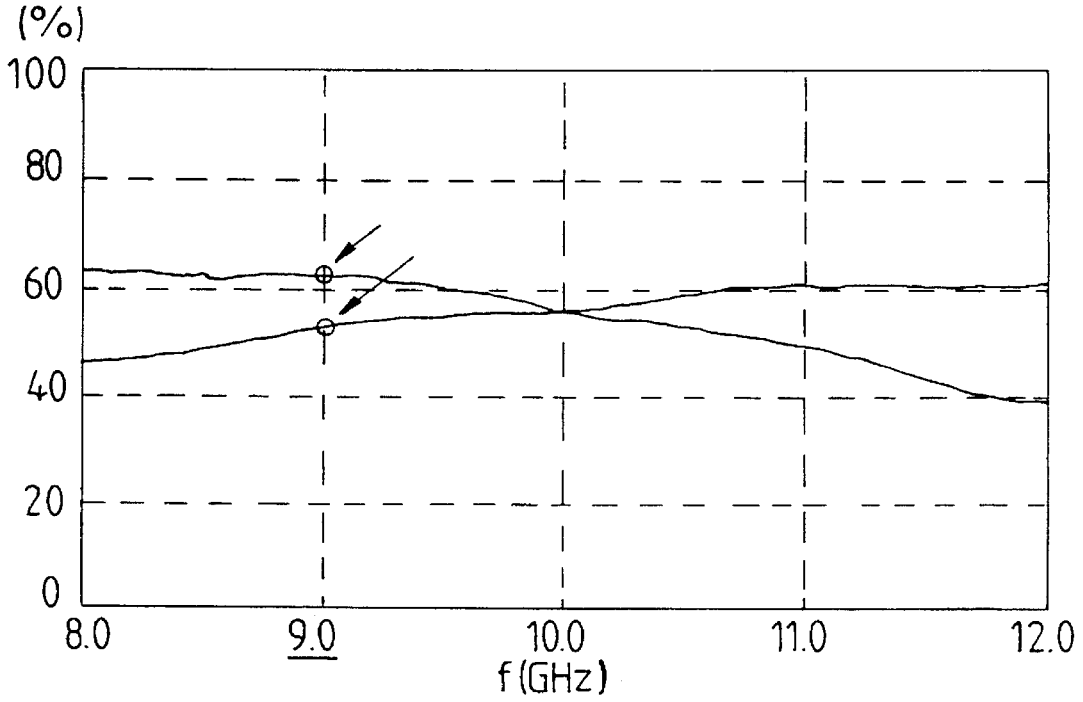
FIGS. 4A and 4B illustrate radar transmission and radar reflexion respectively with different polarization directions for the fabric shown in FIGS. 1A and 1B.
Figure 4B:
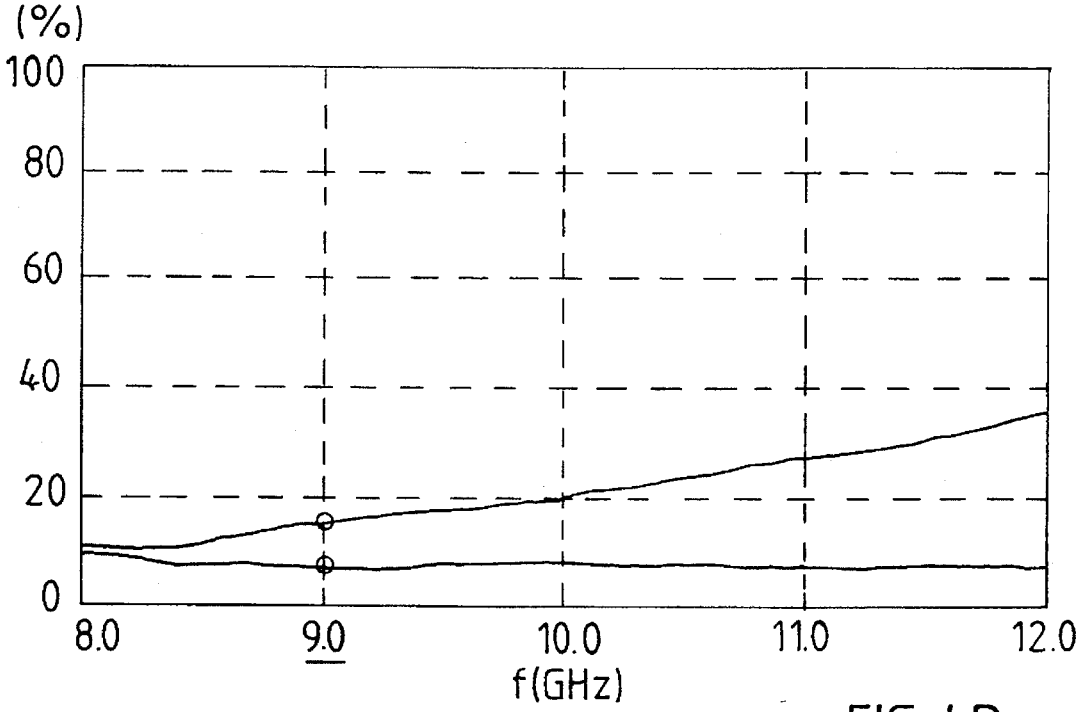

A sample of this fabric was examined with regard to radar reflexion and radar transmission with two polarization directions, according to FIGS. 4A and 4B respectively. It will be seen from FIG. 4A that for 9 GHz, the variation in relation to a mean value is ±8%, and at 10 GHz, the values actually coincide. Neither do the reflexion values differ to any great extent, these values having been compared with a metal plate.

EXAMPLE 2

Figure 2:
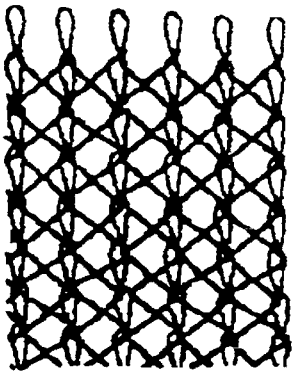
FIG. 2 illustrates another fabric constructed in accordance with the invention.

The fabric illustrated in FIG. 2 has similar radar properties to the fabric illustrated in FIG. 1, and the base fabric has been replaced with a finished polyethylene nonwoven material (Tyvek (TM) 80 g/m$^2$ and one side coated with aluminium). This nonwoven material is pierced by the needles in the warp knitting machine with each "stroke" of the needle bar.

In this example, a yarn Nm 80/2, polyamide/steel 5 percent by weight, was laid-out in a pattern corresponding to 00/11/22/11/, using a laying-out bar and with full needle threading. The same type of yarn was laid using another laying-out bar with a lay-out pattern of 23/21/10/12/. As one skilled in this art will understand, the first-mentioned lay-out is effected in the absence of loops and is, instead, held firmly by the second yarn system, therewith consuming a minimum amount of yarn and achieving the maximum radar effect.

This fabric exhibited similar radar properties to the fabric according to Example 1.

EXAMPLE 3

Figure 3:
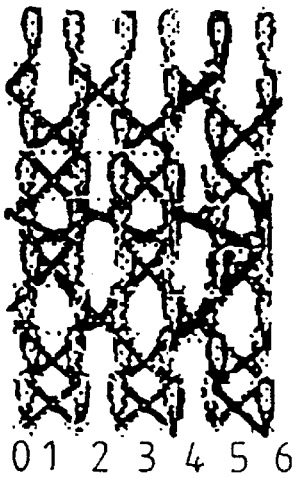
FIG. 3 illustrates a knitted fabric of an earlier known kind.

The fabric illustrated in FIG. 3 has two yarn systems, the first with a yarn lay-out pattern of 12/10/12/23/34. The second yarn system had a lay-out pattern of 23/34/32/12/10. Physically, the fabric was highly elastic in both directions and it was possible to stretch the fabric by almost 100%. The fabric coincides with the description in U.S. Pat. No. 4,064,305, and is actually intended to be used in a stretched state and glued between two sheets of film. All yarn includes metal fibres.

Figure 5A:
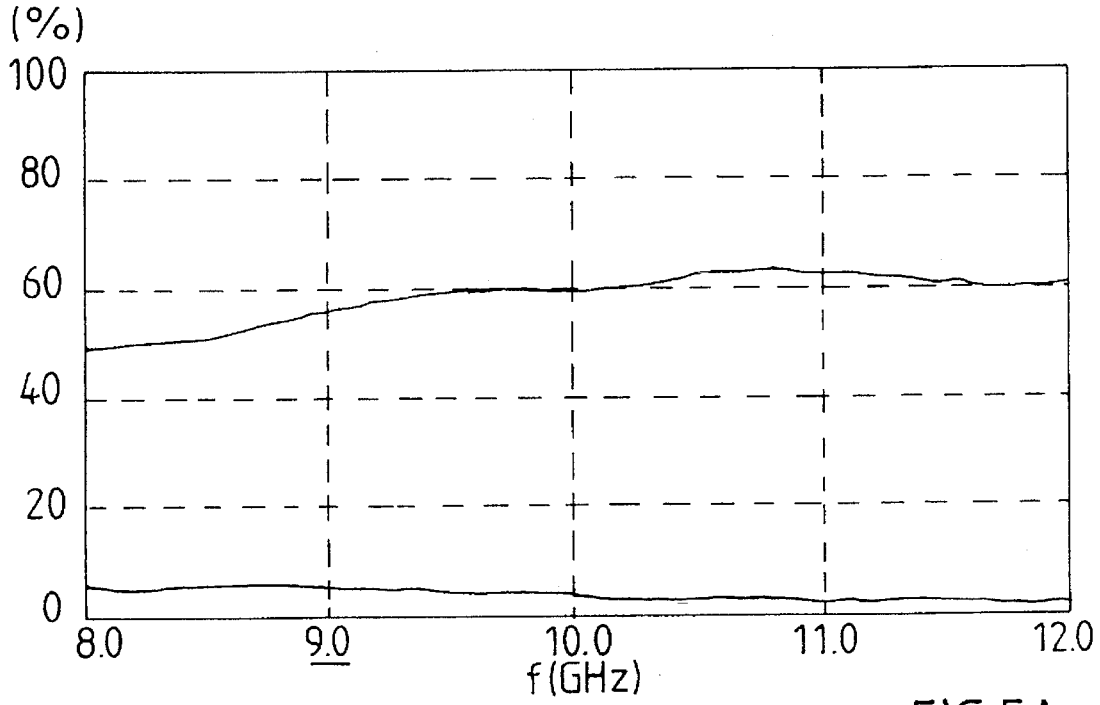
FIG. 5A and FIG. 5B illustrate corresponding transmission and reflexion respectively for the known fabric shown in FIG. 3.
Figure 5B:
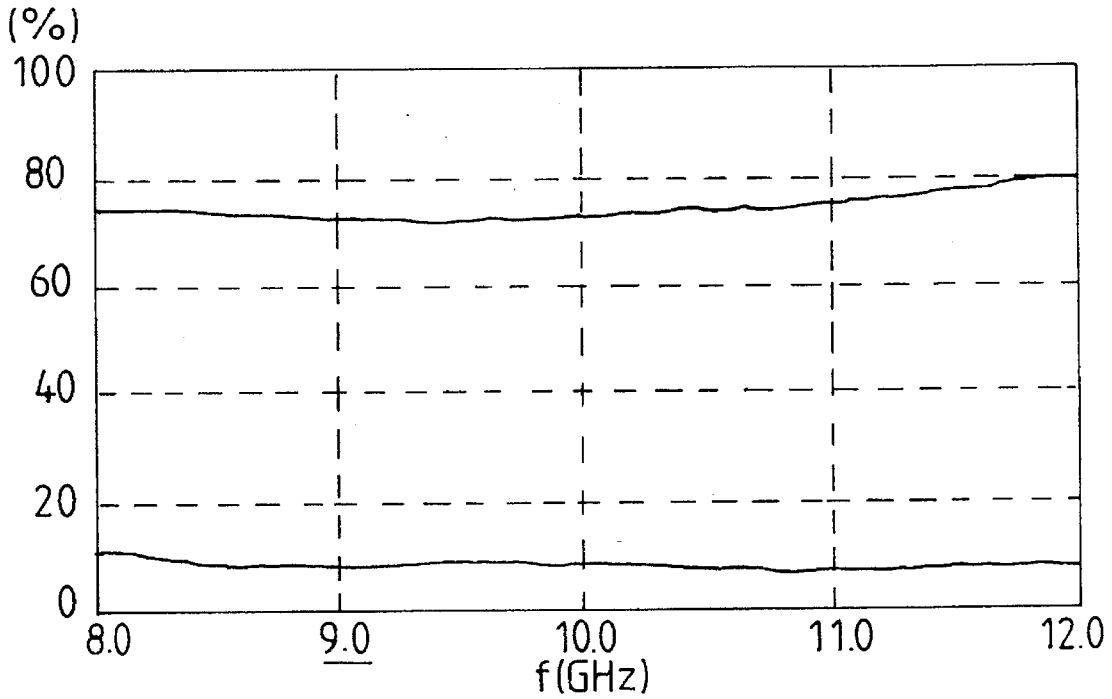

The radar characteristics of this fabric were tested in the same manner as the fabric in Example 1. The results are shown in FIGS. 5A and 5B respectively. It will be seen immediately that the curves for the two polarization directions for the radiation used differ considerably. For instance, the deviation in reflexion at 9 GHz in relation to a mean value is roughly ±40%. In this state, the fabric must be considered unsuitable for use as radar camouflage material. It is also difficult to achieve uniformity in a stretched state, since the stretch percentage is not taken-up uniformly across the width.

The fabrics according to Example 1 and Example 2 are only examples of fabrics that can be constructed in accordance with the invention. For instance, the yarn can be laid-out in an atlas pattern, for instance a lay-out pattern corresponding to (12/23/34/32/21/10)+(32/21/10/12/23/34). In order to obtain sufficient stability, it is preferred to use a stabilizing sheet, either as in Example 1 a base fabric which is made simultaneously and provides mutual stabilization, or as in Example 2 by union knitting while stitching through a finished fabric, this fabric normally, but not necessarily, being a nonwoven fabric.

We claim:

1. A camouflage material having a radar screening effect, comprising a warp knitted fabric in which at least a part of the yarn contains metal fibres, characterized in that the yarn containing the metal fibres is laid with a lay-out technique such that the sum of the extensions of said yarn will be essentially the same in each direction in the plane of the fabric.

2. A material according to claim 1, characterized in that the yarn containing the metal fibres has been knitted together with a shape-stabilizing fabric layer.

3. A material according to claim 2, characterized in that the shape-stabilizing fabric layer is comprised of a simultaneously produced base fabric.

4. A material according to claim 3, characterized in that the simultaneously produced base fabric has a yarn lay-out with long float stitches.

5. A material according to claim 4, characterized in that the long float stitches are formed by lay-outs beneath at least three needles between successive loops.

6. A material according to claim 2, characterized in that the shape-stabilizing fabric is comprised of a sheet through-knitted with yarn containing metal fibres.

7. A material according to claim 6, characterized in that the through-knitted sheet is coated with a light-reflecting metal layer.

8. A material according to claim 1, characterized in that the material is leaf-cut and is attached in an extended state to a supportive net in a quilted fashion.

* * * * *